United States Patent [19]

Alter

[11] 4,279,602

[45] Jul. 21, 1981

[54] APPARATUS FOR MOUNTING AN OUTBOARD MOTOR

[75] Inventor: Hobart L. Alter, Capistrano Beach, Calif.

[73] Assignee: Coast Catamaran Corporation, Oceanside, Calif.

[21] Appl. No.: 64,402

[22] Filed: Aug. 7, 1979

[51] Int. Cl.[3] ..... B63H 21/26

[52] U.S. Cl. ..... 440/63; 248/642

[58] Field of Search ..... 440/53, 55, 63, 56, 440/900, 65; 248/640, 642, 643, 641

[56] References Cited

U.S. PATENT DOCUMENTS

| | | | |
|---|---|---|---|
| 3,063,404 | 11/1962 | Jones | 440/63 |
| 3,342,156 | 9/1967 | Rayner et al. | 440/63 |
| 3,371,893 | 3/1968 | Blanchard, Jr. | 440/63 X |

*Primary Examiner*—Sherman D. Basinger

[57] ABSTRACT

An apparatus for mounting an outboard motor on a boat includes a pair of guide tracks which are adapted to be mounted on the boat and a carriage slidably mounted in the tracks. A motor mounting plate is pivotally mounted on the carriage and is pivotable between a generally horizontal storage position and a generally vertical use position. An outboard motor can be clamped on the motor mounting plate, and when the motor is to be stored, the motor mounting plate is pivoted to its storage position to raise the motor out of the water, and the carriage is moved forwardly on the guide tracks to move the motor into the hull of the boat.

1 Claim, 13 Drawing Figures

15
16
19
21
18
24
17
26
36
25

16
25
21
36
17
26
23

29
51
50
55
52
53
45
49
24
27
22
46
26
28
18
38
46
57
47
37
48
36
43
33
31
25
4

4

25
57
45
46
52
53
29
50
47
36
13
13
43
41
38
34
26
31
33
56
55
49
29
26

APPARATUS FOR MOUNTING AN OUTBOARD MOTOR

BACKGROUND AND SUMMARY

This invention relates to a motor mounting apparatus, and, more particularly, to an apparatus which is adapted to move an outboard motor from a use position in which the propeller of the motor is in the water to a storage position in which the motor is contained within the hull of the boat.

Many sailboats carry an outboard motor for use in maneuvering the boat in harbors and for propulsion in dead air. When the boat is under sail, the motor is preferably removed from the water to eliminate the resistance or drag of the motor. On many boats the motor is simply clamped to the transom when it is to be used, and unclamped and stowed when the boat is under sail. However, this requires lifting the motor into the boat, which can be a cumbersome operation and which entails the risk of dropping the motor into the water, and removing and storing the motor takes time which could more advantageously be devoted to rigging and sailing.

Some sailors merely use the tilting mechanism which is conventionally included as part of the mounting assembly of the motor to tilt the propeller out of the water. However, the motor then sticks out from the stern, which is unsightly and could be hazardous.

Motor mounting devices are available which enable the motor to be pivoted out of the water. However, these devices are different from the inventive motor mounting assembly and are operated in a different manner.

The invention permits a motor to be pivoted out of the water and stored completely inside the hull of the boat. The motor is mounted on a motor mounting plate which can be pivoted to raise the motor to a generally horizontal position, and the motor mounting plate is carried by a sliding carriage so that the motor can be slid into a storage compartment in the hull. The storage operation can be accomplished quickly and easily, and the storage compartment can be closed by a door or panel to conceal the motor and to isolate the motor and the fuel in the motor from the crew. The stored motor is also more secure against theft when the boat is unattended.

DESCRIPTION OF THE DRAWING

The invention will be explained in conjunction with an illustrative embodiment shown in the accompanying drawing, in which.

DESCRIPTION OF SPECIFIC EMBODIMENT

Figures 1, 2, 3:
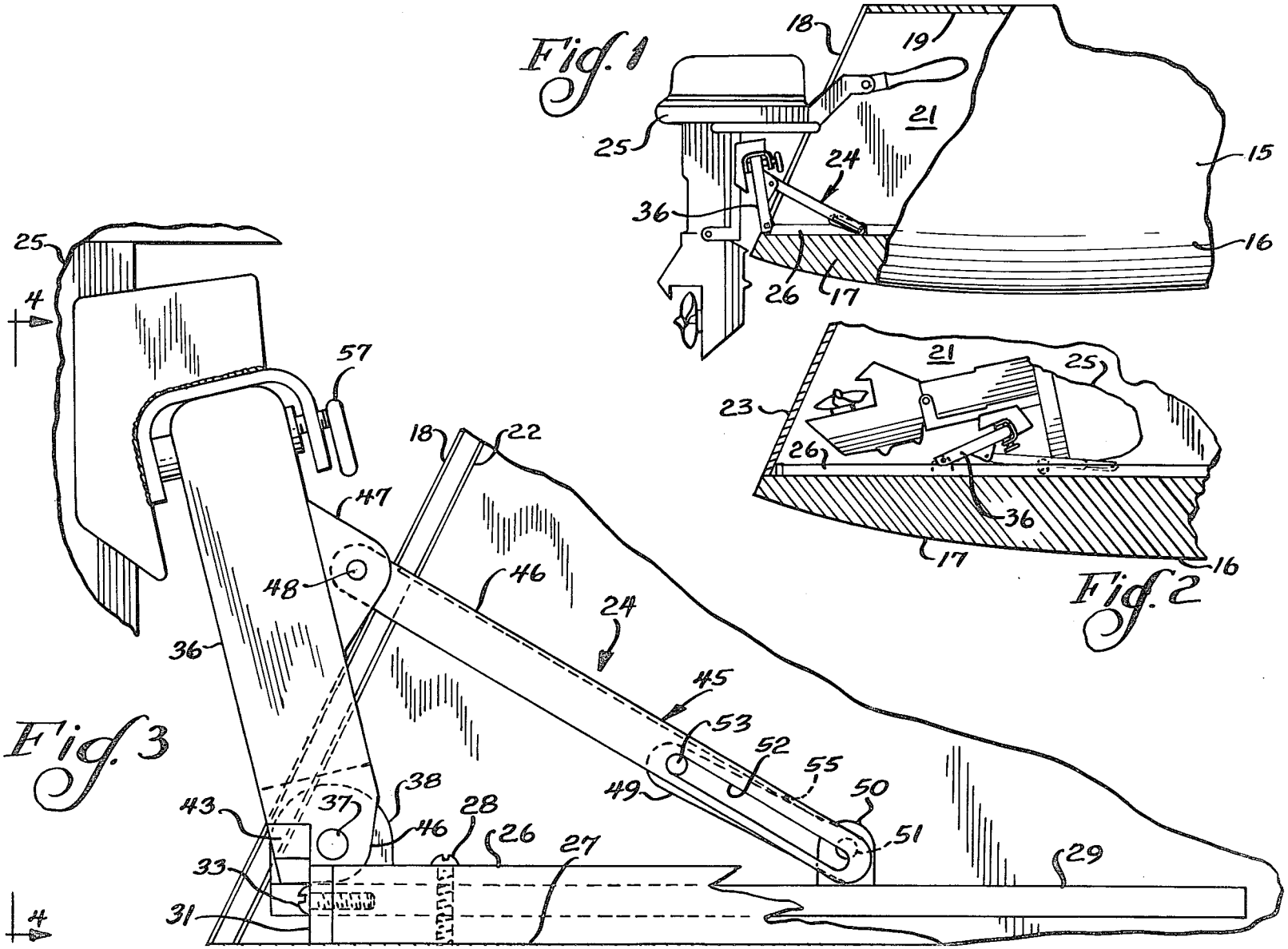
FIG. 1 is a fragmentary side elevational view of a boat equipped with a motor mounting apparatus in accordance with the invention.
FIG. 2 is a view similar to FIG. 1 showing the motor stored within the hull of the boat.
FIG. 3 is an enlarged fragmentary view of a portion of FIG. 1.

Referring first to FIGS. 1–3, a boat 15 includes a hull 16 having a keel 17, a transom 18, and a deck 19. The transom has an opening 20 (see FIG. 4) which provides access to a tunnel-like storage compartment 21 above the water line. The storage compartment is completely covered by the deck and is watertight except at the opening in the transom.

Guide channels 22 (see also FIG. 3) are mounted on the transom at the sides of the opening for slidably mounting a panel 23 (FIG. 2) for closing the compartment. The panel can be provided with a lock for locking the panel closed, and vents can be provided in the panel for ventilating the storage compartment.

A motor mounting assembly 24 is mounted within the storage compartment, and a conventional outboard motor 25 is mounted on the motor mounting apparatus. The motor is shown in its use position in FIG. 1 in which the motor extends generally vertically and its propeller is in the water.

The motor mount assembly includes a pair of channel-shaped guide tracks 26 (see also FIG. 13) which are attached to the flat upper surface 27 of the keel by screws 28. A metal carriage 29 is slidably supported by the guide tracks and is slidable between a rearward or use position illustrated in FIGS. 1 and 3 and a forward or storage position illustrated in FIG. 2. The guide channels are advantageously formed from low-friction material, such as Delrin plastic, so that the carriage slides easily within the guide channels 26.

A pair of stop plates 31 and 32 (FIGS. 3 and 4) are secured to the aft ends of the guide tracks by screws 33 and close the ends of the channels. The end portion of each of the side edges of the carriage is notched or recessed to provide a stop shoulder 34 (FIG. 5) which is spaced forwardly of the rear edge 35 of the carriage and which engages the stop plates of the channels to prevent the carriage from being withdrawn from the channels.

A motor mounting plate 36 is pivotally supported above the carriage by a rod 37 which is mounted in a pair of brackets 38 and 39 attached to the rear end of the carriage. The motor mounting or hinge plate 36 is pivotable on the rod between a use position illustrated in FIGS. 1 and 3 in which the plate extends generally vertically and a storage position illustrated in FIGS. 2 and 6 in which the plate extends generally horizontally. The lower end of the mounting plate is provided with a pair of flat surfaces 41 and 42 (FIG. 5) which diverge away from the pivot rod 37. The rear stop surface 41 is engageable with the top surface of the carriage to prevent pivoting of the plate beyond its use position illustrated in FIG. 3, and the front stop surface 42 is engageable with the top surface of the carriage to prevent pivoting of the plate beyond its storage position illustrated in FIG. 6. The rear stop surface 41 maintains the mounting plate inclined slightly toward the stern of the boat, and the front stop surface 42 maintains the mounting plate inclined slightly from the horizontal.

Figure 4:
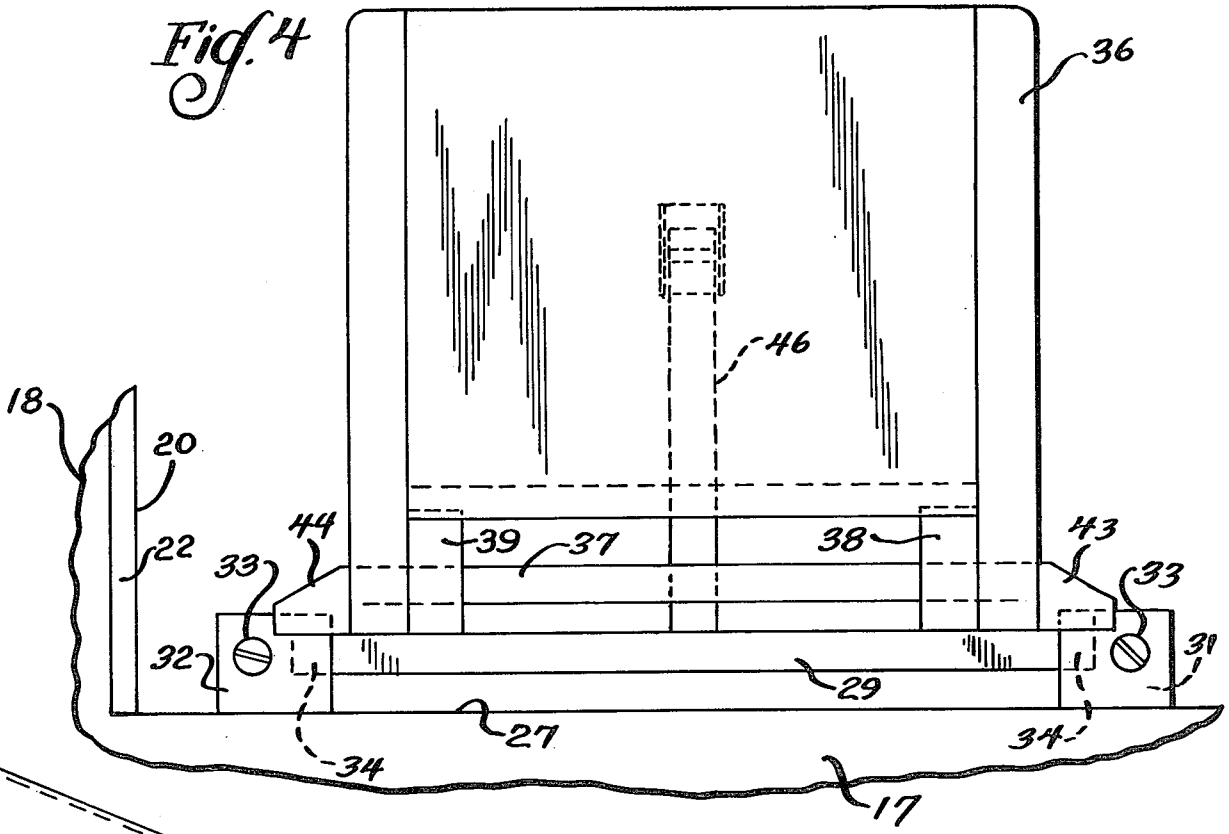
FIG. 4 is a fragmentary end elevational view of the motor mounting apparatus without the motor taken along the line 4—4 of FIG. 3.
Figure 5:
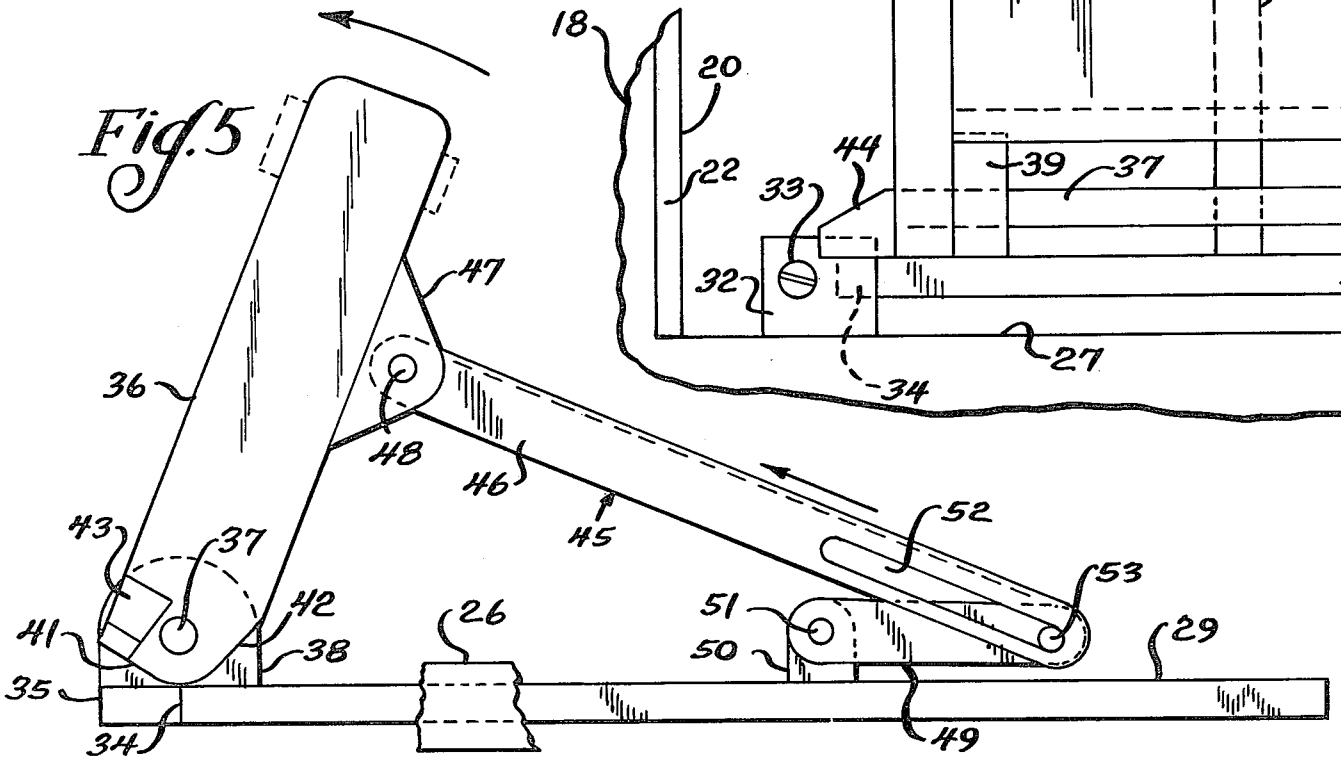
FIG. 5 is a fragmentary view showing the motor mounting plate being pivoted to its storage position.

A pair of stop lugs 43 and 44 (FIG. 4) extend laterally outwardly from the sides of the mounting plate adjacent the rear stop surfaces 41. As illustrated in FIGS. 3 and 4, when the hinge plate is in its use position, the stop lugs 43 and 44 are positioned rearwardly of the stop plates 31 and 32 on the guide tracks and prevent the carriage from sliding forwardly.

A link assembly 45 connects the upper portion of the mounting plate to the carriage. The link assembly includes a link 46 which is pivotally connected to a channel-shaped bracket 47 on the mounting plate by a pin 48 and a link 49 which is pivotally connected to a bracket 50 on the carriage by pin 51. Each of the links 46 and 49 is channel-shaped (see FIGS. 8 and 10), and the width of the link 49 is slightly less than the width of the channel of the link 46 so that the link 49 can slide within the channel of the link 46. A slot 52 is provided in each of the sides of the link 46, and the link 46 is slidably and pivotally connected to the link 49 by a pin 53 which extends into the slots.

Figures 6, 7, 8, 9, 10, 11, 12, 13:
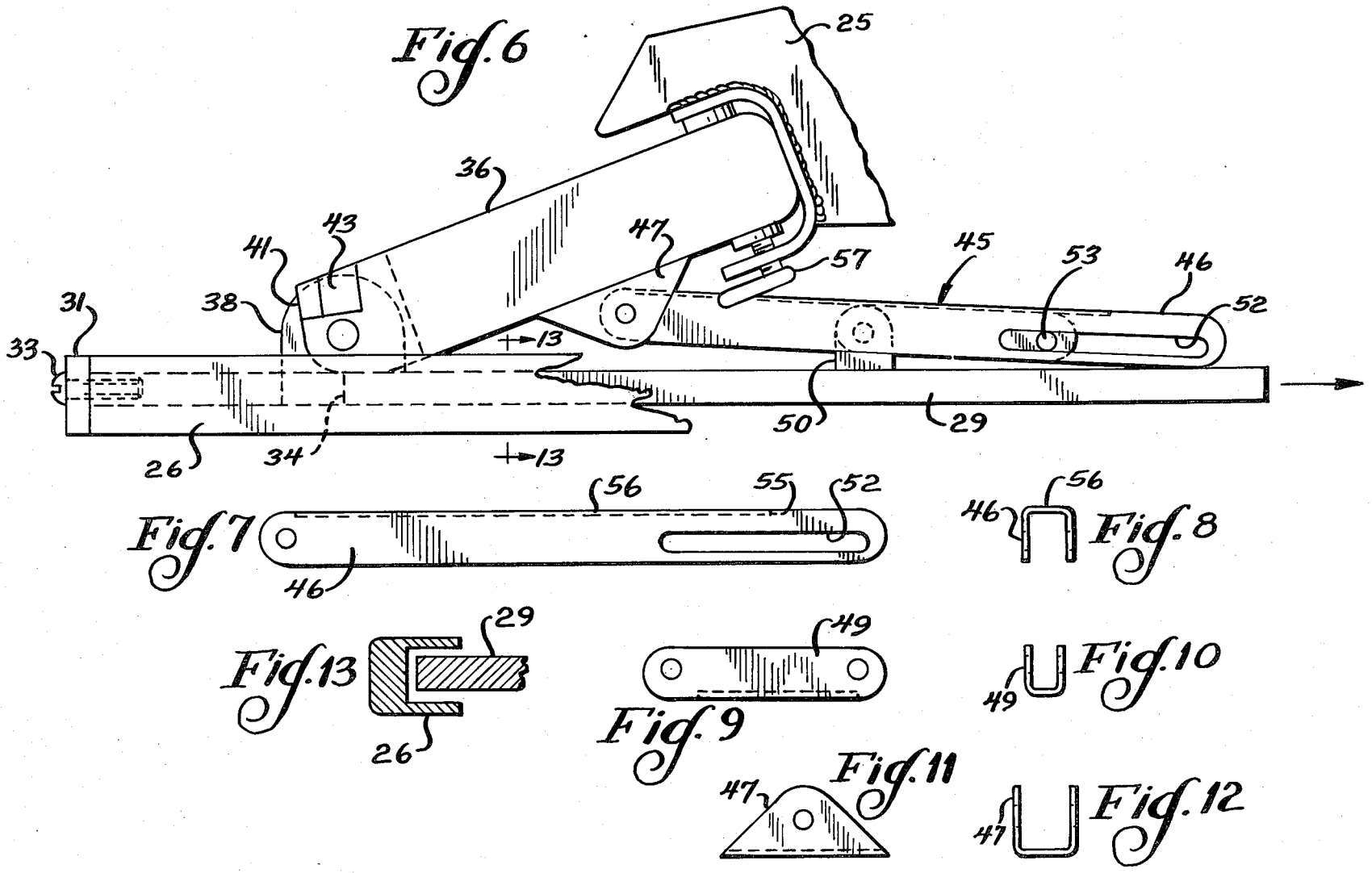
FIG. 6 is a fragmentary view showing the motor mounting plate pivoted to its storage position and the carriage being moved to its storage position.
FIG. 7 is a side elevational view of one of the links of the apparatus.
FIG. 8 is an end elevational view of the link of FIG. 7.
FIG. 9 is a side elevational view of the other link.
FIG. 10 is an end elevational view of the link of FIG. 9.
FIG. 11 is a side elevational view of the link bracket.
FIG. 12 is an end elevational view of the link bracket.
FIG. 13 is a fragmentary sectional view taken along the line 13—13 of FIG. 6.

Referring to FIG. 7, the forward end 55 of the bight portion 56 of the channel 46 terminates rearwardly of the forward end of the channel. When the motor mounting plate is in its use position illustrated in FIG. 3, the link 46 can be pushed manually over center so that the links 46 and 49 are not parallel and so that the end 55 of the bight portion of the link 46 engages the link 49. This prevents the motor mounting plate 36 from pivoting clockwise as view in FIG. 3 until the link 46 is pulled manually over center to permit the link 49 to pivot clockwise about its pivot pin 51.

The motor 25 includes a pair of conventional transom clamps 57 which are clamped onto the motor mounting plate 36 for attaching the motor to the motor mounting apparatus. When the motor mounting plate is in the use position illustrated in FIG. 3, it functions as a transom for supporting the motor so that the propeller can power the boat.

When the motor is no longer needed, the link assembly 45 is manually pulled over center, and the motor mounting plate is pivoted counterclockwise as viewed in FIG. 3 to swing the motor into a generally horizontal position as illustrated in FIGS. 2 and 6. The motor remains clamped to the motor mounting plate, and the weight of the motor need only be pivoted above the pivot rod 37 rather than lifted. When the motor mounting plate is pivoted to its storage position, the forward stop surface 42 engages the top surface of the carriage and supports the motor mounting plate relative to the carriage in the position illustrated in FIG. 6. The stop lugs 43 and 44 on the motor mounting plate are pivoted out of engagement with the stop plates 31 and 32 on the aft end of the guide tracks, and the carriage can be pushed forwardly along the guide tracks as illustrated in FIG. 6 to carry the motor into the storage compartment 21 as illustrated in FIG. 2. When the carriage is in its storage position, the motor is withdrawn completely into the storage compartment, and the storage compartment can be closed by sliding the closure panel 23 into the guide channels 22 on the sides of the opening 20 in the transom.

When it is desired to use the motor again, the reverse procedure is used. The carriage is pushed toward the stern until the stop shoulders 34 engage the stop plates 31 and 32 on the ends of the guide tracks, and the motor mounting plate is then pivoted to swing the motor into a vertical position. As the motor mounting plate is pivoted counterclockwise as viewed in FIG. 5, the link 46 pulls the link 49 upwardly until the links are substantially parallel. The links can then be pushed manually over center to the position illustrated in FIG. 3 for bracing the motor mounting plate against clockwise pivoting movement.

The motor mounting apparatus positions the motor so that one of the crew can stand on the deck 19 or on the upper surface 27 of the keel within the transom opening and operate the pull starter.

When the motor is stowed in the storage compartment, the motor and the fuel in the motor are isolated from the crew by the deck 19, thereby minimizing the danger of explosion by igniting gasoline fumes. The storage compartment also provides a safe place to store a gas tank since the compartment is well ventilated, either by leaving the storage compartment open or by providing adequate vents in the closure panel.

When the closure panel is closed, the motor is completely concealed from view, thereby providing the boat with a clean, sleek appearance. The closure panel can be provided with lock means for locking the panel closed, and the motor is thereby secured against theft when the boat is unattended.

While in the foregoing specification a detailed description of a specific embodiment of the invention was set forth, it will be understood that many of the details herein given may be varied considerably by those skilled in the art without departing from the spirit and scope of the invention.

I claim:

1. A motor mounting apparatus for mounting an outboard motor on a boat, the apparatus comprising:

(a) a pair of guide tracks adapted to be mounted on a boat;

(b) a carriage slidably mounted in the guide tracks and movable between a storage position and a use position;

(c) a motor mounting plate pivotally mounted on the carriage and being pivotable between a storage position and a use position; and (d) over center link means for preventing movement of the motor mounting plate from the use position to the storage position, the over center link means including a first link pivotally connected to the motor mounting plate and a second link pivotally connected to the carriage, the first and second links being pivotally connected to each other.

* * * * *